United States Patent [19]

Ross

[11] 4,061,913

[45] Dec. 6, 1977

[54] COLLAPSIBLE LAMP SHADE FRAME

[76] Inventor: Joseph D. Ross, 114 Angas Road, Westbourne Park, South Australia, Australia, 5041

[21] Appl. No.: 639,814

[22] Filed: Dec. 11, 1975

[30] Foreign Application Priority Data

Dec. 18, 1974 Australia ..... PC0050/74

[51] Int. Cl.[2] ..... F21V 1/06

[52] U.S. Cl. ..... 362/357; 362/352

[58] Field of Search ..... 240/11.2 R, 36, 46.09, 240/46.27, 46.39, 46.37, 46.41, 46.43, 81 C, 108 R, 108 A, 108 D, 129, 134, 142, 145

[56] References Cited

U.S. PATENT DOCUMENTS

| | | | |
|---|---|---|---|
| 2,683,800 | 7/1954 | Tradelius | 240/108 D |
| 2,702,341 | 2/1955 | Tradelius | 240/108 D |
| 3,162,377 | 12/1964 | Ozeki | 240/108 D |
| 3,194,959 | 7/1965 | Bashaw | 240/108 D |

FOREIGN PATENT DOCUMENTS

| | | | |
|---|---|---|---|
| 671,722 | 10/1963 | Canada | 240/108 R |
| 1,514,017 | 3/1967 | France | 240/108 R |
| 602,481 | 3/1960 | Italy | 240/108 R |

*Primary Examiner*—EdnaM. O'Connor

[57] ABSTRACT

A lamp shade assembly in which a series of ribs and annular spacers for the ribs are adapted to stack together as a pack but, when assembled on the spacers form an annular lamp shade. The spacers have an interlocking configuration for the ribs at spaced intervals arranged so that the ribs are held in interlock with the spacers by flexure of the materials from which at least the ribs are formed.

7 Claims, 13 Drawing Figures

FIG. 12
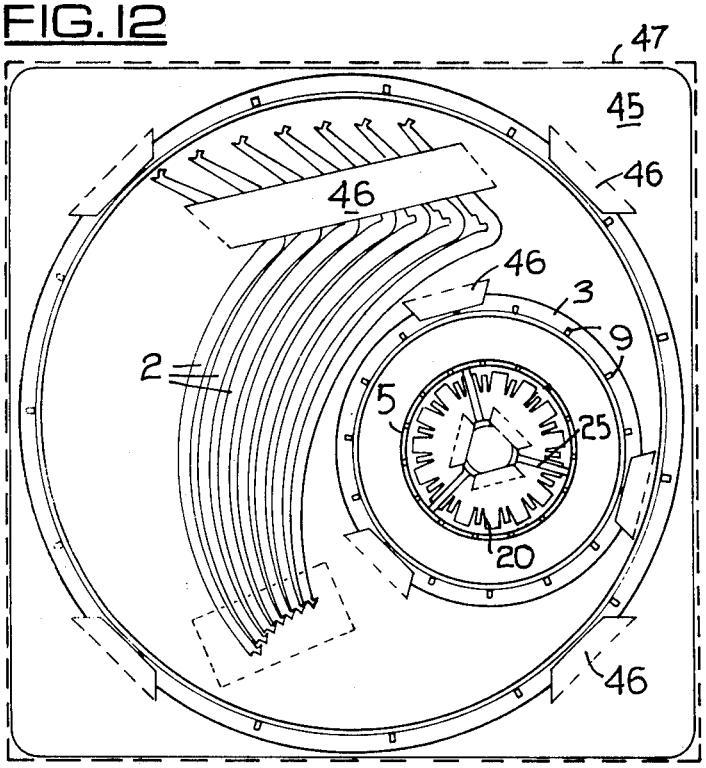
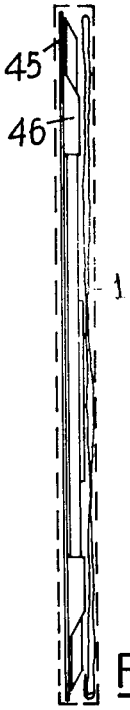
FIG. 12A
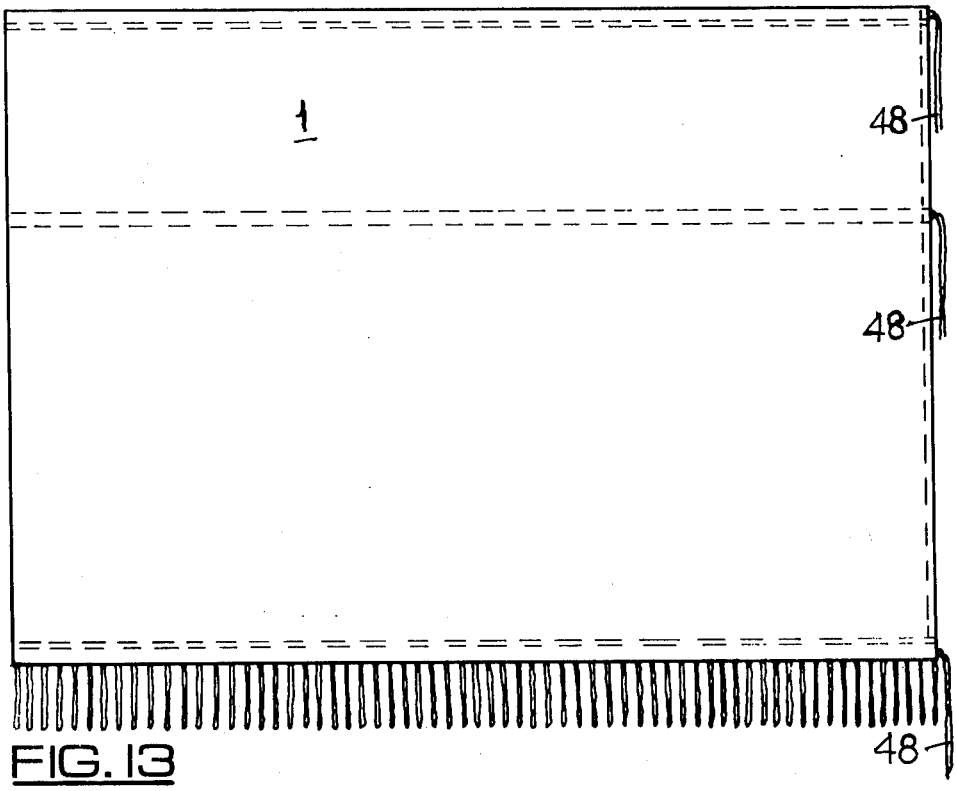
FIG. 13

COLLAPSIBLE LAMP SHADE FRAME

FIELD OF THE INVENTION

This invention relates to a collapsible lamp shade frame and method of use.

BACKGROUND OF THE INVENTION

One of the problems in the construction of lamp shades is to be able to ensure ready storage and transport from the time they are constructed until they are placed into use.

Lamp shades therefore have generally been of a form such that a series of shades could be nested together by placing one over the other and such a nested set was then transported.

Nesting of course limits the shape of such a shade and also, in spite of nesting, the package is still of considerable dimension.

SUMMARY OF THE INVENTION

As transporting of lamp shades is one of the major problems, it is therefore an object of the present invention to provide a collapsible lamp shade which will not be subject to transporting problems in that the lamp shade according to the present invention has an extremely small dimension when collapsed.

A further object of the invention is to provide such a lamp shade which can be transported in an unassembled form but is of constructed such that assembly is simple and can be carried out by the purchaser with a minimum of effort.

The present invention achieves these objects by the manner in which the frame is constructed, the actual construction involving (a) a series of members which will herein be referred to as ribs, and (b) members which form the connectors and spacers for the ribs, herein referred to as spacers, the important feature of the invention being that the construction is such that a plurality of spacers hold the ribs at spaced location, and the ribs when engaged on the spacers are loaded to achieve an interlock by applied tension. Thus the ribs can engage a pair of spacers with loading in one direction caused by an intermediate spacer which loads the ribs in the opposite direction, whereby the ribs remain firmly in place because of tension, or the ribs can engage one spacer with an interlock to cause the ribs to be tensioned against another spacer, or the ribs can have the interlock formed by tension of the materials at the interlock.

Thus for instance a lamp shade can be constructed having an upper ring-shaped spacer and a lower ring-shaped spacer, the ends of the ribs, or intermediate parts, being shaped to engage and lock to these spacers, but a third intermediately positioned spacer is arranged to also engage the ribs but to load the ribs so that they are in firm engagement with the other two spacers. The fabric can add to this hold by loading the ribs in the same direction.

It will be realised of course that the spacers can be any shape and can vary in number, but they are formed to hold the ribs in position.

The ribs and spacers are shaped at the interengaging locations to give precise location of the ribs and ensure their correct engagement and retention on the spacers by resulting tension.

A lamp shade assembly according to this invention can thus comprise a series of ribs, and spacers for the ribs, the ribs being planar members adapted to stack together as a pack but, when assembled, to define a lamp shade, there being at least a main spacer which preferably supports the lamp socket and engages the ribs at a selected locality, and a second spacer which engages the ribs at a remote locality, which spacers are themselves adapted to be spaced apart by the ribs, both the ribs and the spacers having interlocking configuration for the ribs at spaced intervals, whereby the ribs are held in interlock with the spacers by flexure of the materials from which at least the ribs are formed.

Conveniently the ribs are moulded to have a generally flat configuration in one plane but of required depth, notched inwardly near each end and outwardly intermediate the ends so that the notches engage appropriate parts of the spacers to give the required holding loading, but it will be realized that the ribs could for instance be made of wire which could be shaped at appropriate locations to engage complementary configurations of the spacers, and the spacers could also be made of wire, but preferably the inner spacer in the case of a three spacer assembly, or the top spacer in a two spacer assembly is in the form of a disc which is apertured to take a lamp socket or lamp support.

Such a frame can then be covered with fabric, which expression herein includes any covering material which is to form the body of the lamp shade itself, and this material can be preshaped so that it can be clipped or drawn into position and held on to the ribs.

Because the ribs can all be formed of simple planar materials and can be completely flat in their construction in spite of ornamental configurations at right angles thereto, a series of such ribs can be nested together in a single plane and these fit between the spacers which again can be nested in the general plane so that an assembly which forms the frame of the lamp shade can then be packed in a flat package much in the form of record packages, with the material which is to form the body of the shade also packed flat in this package so that as far as transport is concerned, a flat package of minimal depth results which can then be handled much in the same way as a record package and requires a very small amount of space during transport, yet because of the simple construction which causes the various members to be held in position due to the interlock and tension of the members when assembled, can be readily assembled after purchase by first assembling the frame and then fitting the shade around it.

BRIEF DESCRIPTION OF THE DRAWINGS

In order however that the nature of the invention may be more fully appreciated an embodiment thereof will now be described with reference to the accompanying drawings, which are however to be taken as illustrative only and not limiting the invention to the form shown.

In the drawing:

FIG. 12 is a plan view of a pack containing the components of the lamp shade.

FIG. 12A shows an end elevation of such a pack, and

FIG. 13 is a view of the fabric which in use is drawn over the ribs and spacers.

DETAILED DESCRIPTION

Referring first to the form shown in FIGS. 1 to 7 the fabric which forms the normally visible part of a lamp shade when in use is designated 1 and as will be noted, covers the ribs and spacers.

Figure 1:
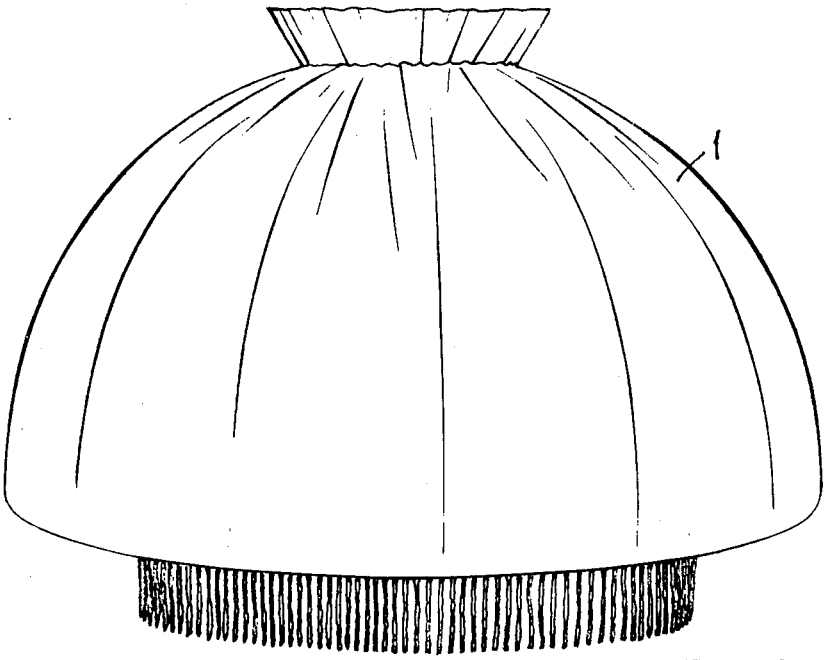
FIG. 1 is a perspective view of a lamp shade according to this invention.
Figure 2:
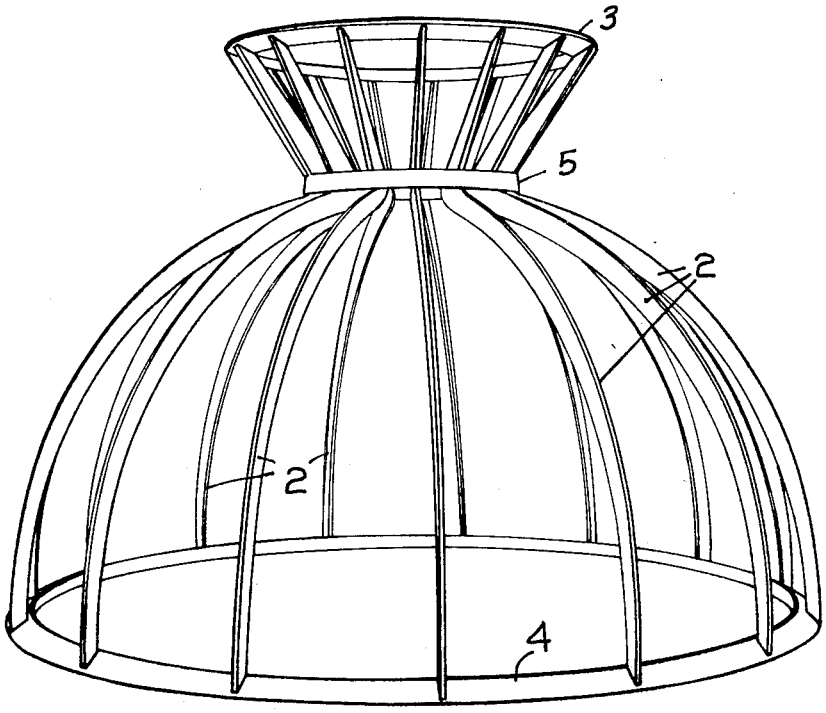
FIG. 2 is a perspective view showing the skeleton of the lamp shade comprising the ribs and the spacers.
Figure 3:
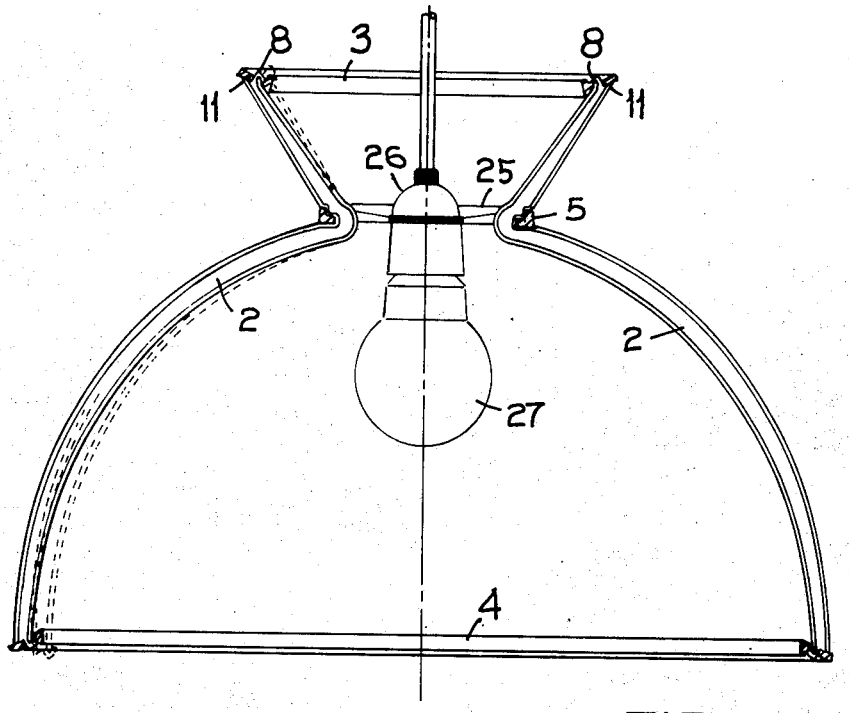
FIG. 3 is a somewhat schematic view taken only on the medial line of the lamp shade indicating the position of the light source and showing how the ribs are held in place by means of the spacers, and showing in dotted lines the position of a rib before it is tensioned by engaging it on the spacers.
Figure 4:
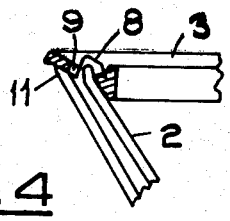
FIG. 4 is an enlarged fragmentary detail of the upper end of a rib showing it engaging the upper spacer.

In FIG. 2 is shown a series of identical ribs 2 engaged by an upper spacer 3, a lower spacer 4 and an intermediate spacer 5.

FIGS. 4, 5, 6 and 7 show details respectively of the junctions of the ribs 2 with the respective spacers, from which it will be noted that at the upper end of each of the ribs 2 is a hook shaped member 8 which engages through an aperture 9 in the spacer 3 and hooks against a surface on the spacer 3, a projection 11 on the rib 2 engaging the underside of the spacer 3 to prevent the end of the rib 2 from moving through the aperture 9, whereby the assembly, because of the dimension of the aperture 9 allows the part 8 to project through the aperture 9 but if the end of the rib is loaded inwardly, the hook shaped portion 8 on the rib will engage the spacer 3 to lock it thereto.

A similar arrangement exists at the lower end of each of the ribs in that the spacer 4 has an aperture 15 through it at the location of each rib, the rib again having a finger 16 which can hook to the spacer 4 when the lower end of the rib 2 is inwardly loaded. A projection 17 on the rib engages the surface of the spacer 4.

Figure 6:
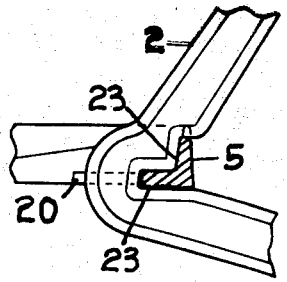
FIG. 6 is an enlarged fragmentary detail showing the engagement of a rib with the intermediate spacer.

The intermediate spacer 5 is of a diameter such, in relation to the upper and lower spacers, it applies an inward tension to the intermediate part of the ribs 2 and, as shown, the spacer 5 can have fingers 20 whereby the ribs 2 are located and maintained in correct position, the fingers 20 being hook shaped at 21 to provide an opening into which the ribs can be engaged. The ends of the fingers 20 can be forced apart when inserting the ribs 2 but then will tend to hold the ribs in position due to the inward flexing of the fingers, the ribs preferably being shaped as shown in FIG. 6 to have surfaces 23 which engage the spacer 5 to increase the hold and ensure correct alignment of all of the ribs 2.

The spacer 5 has inwardly projecting members 25 which support a lamp holder 26 so that a lamp 27 is located in the area bounded by the ribs and is hidden from view by the fabric or other cover in a normal manner.

Figure 5:
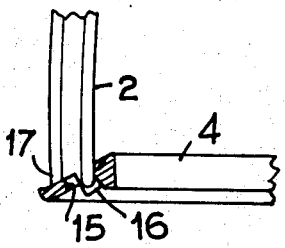
FIG. 5 is a fragmentary detail of the lower end of a rib showing it engaging the lower spacer.
Figure 7:
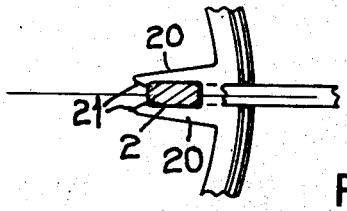
FIG. 7 is a plan view of the structure in FIG. 6, but showing part of the rib broken away to show its cross-section.
Figure 8:
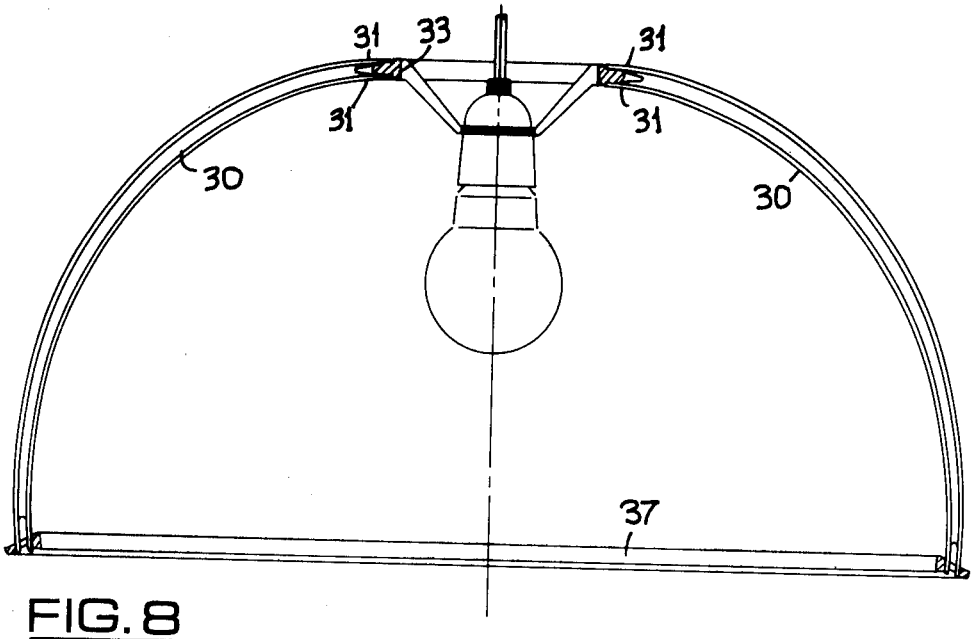
FIG. 8 is a view of a modified form of lamp shade, the view corresponding to FIG. 3 but showing how the ribs can be held by a pair of spacers instead of three spacers as in the first described embodiment, FIG. 9 in an enlarged fragmentary sectional view of the attachment of the ribs to the upper spacer.
Figure 9:
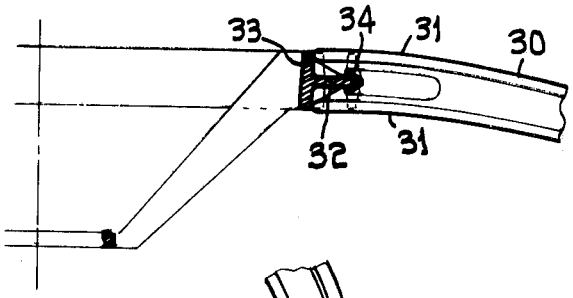
Figure 10:
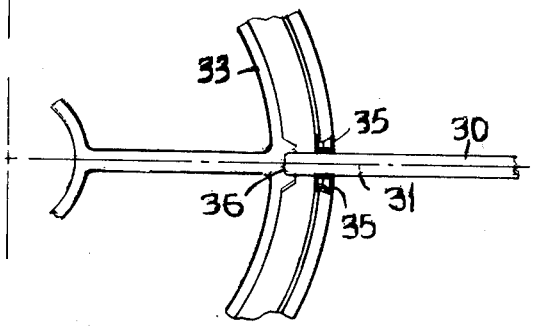
FIG. 10 is a plan view of the structure of FIG. 9.

Referring now to FIGS. 8, 9, 10 and 11 it will be noted that in this modification the upper spacer of the previously described embodiment is not required because the ribs in this case engage the upper spacer in such a manner that the ribs have their lower ends loaded inwardly to again engage the lower spacer in a manner similar to the engagement shown with reference to FIG. 5.

The ribs, in this case designated 30, are held in place by having their ends split to form two fingers 31 which engage an outward flange 32 on the spacer 33, the flange having an arrow-shaped head 34 and the fingers being shaped to move over the head and lock to it. The spacer 33 has lugs 35 on it to orientate the ribs 30 and recesses 36 to ensure orientation, and these ribs 30 can thus be engaged on the spacer 33 with a firm hold, but if the form shown in FIG. 5 is used the ribs are shaped to give an inward loading so that the lower ends of the ribs must be urged outwardly to make the necessary firm connection with the lower spacer which in this case is designated 37.

Figure 11:
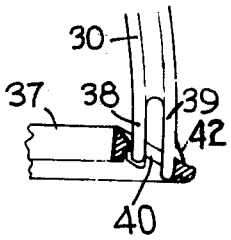
FIG. 11 is an enlarged fragmentary view of a rib engaging the lower spacer.

Instead of however loading the rib in the manner described, a similar effect, or added lock, can be obtained by the arrangement shown in FIG. 11, where it will be seen that the hooked finger 38 on the rib can have a second finger 39 adjacent to it, and this loads the finger 38 against the surface of the spacer 37, there being enough spring in the fingers to allow the biforcated end of the rib 30 to be inserted through the aperture 40. The finger 38 has a hook on it and the finger 39 can have a lug 42 to confine the ends of the ribs on the spacer 37.

From the foregoing it will be realized that the basic principle of the invention is the use of a series of ribs which engage spacers in such a way that the ribs are locked in position on the spacers and are held with a sufficient rigidity to allow a fabric or other member to be placed over the outside of the skeleton so formed to complete the lamp shade.

The resultant lamp shade is simple and highly effective and permits effective packaging in that the components can be transported while in their flat packaging position as shown in FIG. 12, using a support such as a square card 45 with tongues 46 to locate the members, a cover 47 then enclosing the assembly. The fabric 1 is included in the pack, and as shown in FIG. 13, the fabric can have draw cords 48 to shape it around the assembled ribs and spacers.

Frames comprising ribs and spacers could of course be supplied separately as they are saleable in themselves without the fabric or other cover material.

By using the system of notching or forming interengaging members between the ribs and the spacers, the assembly when once erected will be stable, and as stated this configuration can be so carried out that when the covering material, in this specification included in the term "fabric" is pulled into position, the whole structure can be still further locked together by preventing withdrawal of the ribs from the rings.

What is claimed is:

1. A lamp shade assembly comprising a series of ribs, and annular spacers for the said ribs, the said ribs being planar members shaped to stack together as a pack and being assemblable on the spacers to define an annular lamp shade shape, a main spacer to engage the ribs intermediate the ends thereof, and further spacers which are positioned to engage the ribs remotely from the main spacer on each side thereof, which spacers are themselves spaced apart by the said ribs, said spacers having interlocking configuration for the ribs at spaced intervals, said spacers and ribs being of a configuration whereby the ribs are held in interlock with the spacers by flexure of the materials from which at least the said ribs are formed.

2. A lamp shade assembly according to claim 1 wherein said ribs are shaped to engage the respective spacers at spaced intervals and to be flexed into engagement with said spacers, the said main spacer being dimensioned to load the ribs against the spacers at the locations of contact of the ribs with the spacers.

3. A lamp assembly according to claim 2 wherein said main spacer is shaped to load the ribs outwardly whereby to have an inward loading of the ribs on the said remote spacers.

4. A lamp shade assembly according to claim 2 comprising hook-shaped portions on said ribs where they engage the said further spacers and projections also on the said ribs to engage said further spacers whereby to locate said ribs on said spacers.

5. A lamp shade assembly according to claim 2 comprising pairs of fingers on said main spacer defining an opening between each said pair to engage a corresponding rib, said fingers being hook-shaped to confine said ribs in said openings when inserted thereinto.

6. A lamp shade assembly comprising a series of ribs, annular spacers for the said ribs, said ribs being planar members capable of being stacked together as a pack and being assemblable on said spacers to define an annular lamp shade shape, said spaces including a main ring-shaped spacer engaging the ribs intermediate their ends, a second ring-shaped spacer engaging the ribs at one end of said ribs, and a third ring-shaped spacer engaging the other end of said ribs, said spacers themselves being spaced apart by said ribs, said spacers having interlocking configuration for the ribs at spaced intervals, said ribs being shaped and said spacers dimensioned so that the ends of said ribs are flexed during assembly to engage said second and third spacers, whereby the ribs are held in interlock with the spacers by flexure of the materials from which at least the said ribs are formed.

7. A lamp shade assembly comprising a series of ribs, annular spacers for said ribs, fabric for covering the ribs when assembled on said spacers, and a card for releasably holding said ribs and spacers, said ribs being planar members shaped to stack together as a pack and being assemblable on the spacers to define an annular lamp shade shape, said spacers including a main spacer positiond to engage the ribs intermediate the ends thereof, and two further spacers engaging the ribs at a locality remote from the main spacer, said spacers themselves being engaged and spaced apart by the said ribs, said spacers having interlocking configuration for the ribs at spaced intervals, whereby the ribs are held in interlock with the spacers by flexure of the materials from which at least the said ribs are formed and by the said fabric when placed over the assembled ribs and spacers.

* * * * *